US009714809B1

(12) United States Patent
Bond

(10) Patent No.: US 9,714,809 B1
(45) Date of Patent: Jul. 25, 2017

(54) LAMINATED ELECTROACTIVE POLYMER BOW

(71) Applicant: Victor Bond, Monterey, CA (US)

(72) Inventor: Victor Bond, Monterey, CA (US)

(73) Assignee: Victor Bond, Walnut Creek, CA (US)

( * ) Notice: Subject to any disclaimer, the term of this patent is extended or adjusted under 35 U.S.C. 154(b) by 0 days.

(21) Appl. No.: 15/058,081

(22) Filed: Mar. 1, 2016

Related U.S. Application Data

(60) Provisional application No. 62/126,683, filed on Mar. 1, 2015.

(51) Int. Cl.
*F41B 5/00* (2006.01)
*F41B 5/14* (2006.01)

(52) U.S. Cl.
CPC ..... *F41B 5/1403* (2013.01); *F41B 5/00* (2013.01); *F41B 5/0021* (2013.01)

(58) Field of Classification Search
CPC ..... F41B 5/00; F41B 5/001; F41B 5/0021; F41B 5/0057; F41B 5/0063; F41B 5/0068; F41B 5/10; F41B 5/14; F41B 5/1403
USPC ..... 124/23.1, 25.6, 86, 88
See application file for complete search history.

(56) References Cited

U.S. PATENT DOCUMENTS 261,610 A * 7/1882 Howe ..... F41B 5/00 124/23.1
3,502,062 A * 3/1970 Shurts ..... F41B 5/1426 124/23.1
3,657,040 A * 4/1972 Shobert ..... B29C 70/525 124/23.1
4,478,202 A * 10/1984 Anderson ..... F41B 5/10 124/23.1
4,662,344 A * 5/1987 Mitchell ..... F41B 3/02 124/22
5,165,382 A * 11/1992 Morrison ..... F41B 5/10 124/23.1
5,353,777 A * 10/1994 Fincher ..... F41B 5/10 124/16
5,408,982 A * 4/1995 Doornenbal ..... F41B 5/0094 124/23.1
5,657,739 A * 8/1997 Smith ..... F41B 5/0063 124/23.1
5,881,704 A * 3/1999 Andrews ..... F41B 5/0078 124/23.1
5,934,264 A * 8/1999 Doornenbal ..... F41B 5/0005 124/23.1
6,698,413 B1 * 3/2004 Ecklund ..... F41B 5/10 124/23.1

(Continued)

*Primary Examiner* — Alexander Niconovich

(57) ABSTRACT

An electronic recurve bow includes an electronic control riser having a body configured to be held in a hand of a user, wherein the body includes a power supply configured to provide operating power, a user input configured to receive a user selection of a draw weight for the bow, a controller configured to receive the user selection of the draw weight from the user input and configured to output electronic control signals in response to the user selection of the draw weight, and a pair of electronically controlled laminated electroactive polymer limbs coupled to the electronic control riser, wherein each limb comprises a base material and an electronically controllable material, wherein the electronically controllable material comprises a material having a variable stiffness in response to the output electronic control signals.

21 Claims, 4 Drawing Sheets

(56) References Cited

U.S. PATENT DOCUMENTS

| | | | | |
|---|---|---|---|---|
| 6,712,057 | B2 * | 3/2004 | Andrews | F41B 5/0026 124/23.1 |
| 8,656,713 | B2 * | 2/2014 | Browne | F03G 7/005 124/17 |
| 2014/0261355 | A1 * | 9/2014 | Peacemaker | F41B 5/1403 124/23.1 |

* cited by examiner

LAMINATED ELECTROACTIVE POLYMER BOW

CROSS-REFERENCE TO RELATED APPLICATIONS

The present invention claims benefit to and is a non-provisional of U.S. App. No. 62/126,683 filed Mar. 1, 2015. The present invention is related to U.S. application Ser. No. 14/874,331 filed Oct. 2, 2015. These applications are incorporated by reference herein for all purposes.

BACKGROUND OF THE INVENTION

The present invention relates to a recurve bow. More particularly, the present invention relates to a recurve bow with electronically tunable draw weights.

In archery, bows have a draw weight that represents the amount of force the bow can impart upon an arrow released toward a target. With non-compound bows, such as recurve bows, the amount of force a user has to pull on the string to draw an arrow back is an increasing function. Beginners typically use bows that have lower draw weights, e.g. 151*bs*-251*bs*, intermediates use bows that have higher draw weights, e.g. 251*bs*-451*bs*, and advanced archers use bows with even higher draw weights, e.g. 451*bs*+.

Due to the high investment costs in purchasing a bow, unless the user is very interested in archery, the user will typically borrow a bow. This is disadvantageous to the user, because the borrowed bow may often may not have a suitable draw weight for the user. If too heavy or too light, the user may not enjoy the archery experience and may come to dislike archery.

As a typical archer becomes stronger or more skilled in using a bow, the user may desire to purchase bows having higher and higher draw weight. This is so that the archer can reach a target quicker, can shoot an arrow with less arrow drop, or the like. Archers often delay such upgrades, because the high costs of quality bows. To reduce the costs of upgrading recurve bows, some recurve bows have user-replicable limbs having different draw weights. The limbs can be attached and detached from the recurve bow by the user. Although the costs of such user-replaceable limbs is lower than an entire new bow, they can still be considered expensive to users. The inventor believes that another downside is that if multiple users at different skill levels want to share the use of the bow, the users will have to constantly take off first user-replaceable limbs, put on second user-replaceable limbs, etc. for the different users.

In light of the above, the inventor believes there is need for a recurve bow that addresses the drawbacks described above as well provide new benefits.

SUMMARY OF THE INVENTION

The present invention relates to a recurve bow. More particularly, the present invention relates to a recurve bow with electronically tunable draw weights.

Various embodiments of the present invention include a limb having an electronically tunable draw weight. The limbs include a laminate structure including a rigid base material such as: wood, fiberglass, carbon fiber, ceramic carbon fiber, foam carbon fiber, metal or the like. In addition, the laminate structure includes an electronically tunable stiffness material, such as: an electroactive polymer, a dielectric electroactive polymer, an ionic electroactive polymer, or the like, sandwiched by conductive electrodes (e.g. Vandium Oxide). In operation as different amounts of power is provided to the conductive electrodes, the stiffness of the electronically tunable stiffness material changes, e.g. increases or decreases. As the stiffness of the material changes, the draw weight of the limbs change, and the amount of force imparted upon an arrow changes.

In some embodiments, the draw weight of the limbs are electronically controlled by a controller and power supply disposed within a riser portion of a bow. In other embodiments, an controller separate from the bow can be used to determine the appropriate amount of power to supply to the limbs, and a power supply disposed within the bow can provide the appropriate amount of power. In such embodiments, a wired or wireless communications mechanism (e.g. Wi-Fi, Bluetooth, ZigBee), can be used to communicate between the bow and the external controller (e.g. a laptop, a smart device, a remote server). In still other embodiments, both an external controller and a controller disposed within the bow may be used to control the draw weight of the electronically controllable limbs.

In various embodiments, a number of sensors may also be disposed within the bow to capture bow usage data. In some examples, a MEMS-based accelerometer may be used to determine movement data such as whether the bow is pointed downwards, upwards, etc., when the string is released by a user, movement data as the string is released, and the like. In other examples, a MEMS-based gyroscope may be used to determine angular data, such as the direction or heading of a bow (e.g. left/right), the angle or elevation of the bow (e.g. level, up 10 degrees, etc.), and the like. In other examples a magnetometer may be used to determine heading of the bow, e.g. which direction the bow is pointed, especially when the arrow is released. A GPS receiver may also be used in some embodiments, so that the user's location may be tracked, especially the location where an arrow is released. A strain sensor may be used in some embodiments to determine approximately how hard an arrow is released, e.g. the force imparted upon the arrow when it is released.

In various embodiments, combinations and sub-combinations of the above sensors may be used to determine data such as: when a user releases an arrow, where the users geographically releases an arrow, what direction the arrow is headed, how hard the arrow is shot, the angle the arrow is released, the number of arrows released, and the like. Such data may be recorded in a memory internal to the bow. The recorded data may be transmitted via one of the above communications mechanism to an external receiver, e.g. laptop, smart device, remote server on demand, in real-time, or the like.

In various embodiments, the electronically controlled limbs may be fastened and removed from a limb portion of a bow, whereas in other embodiments, they may be non-removable from the riser portion. In some embodiments where the limbs are user-removable from and user-fastenable onto an electronic riser, to facilitate the electronic connection between the parts, the riser includes a series of spring-loaded pins (two or more), and the limbs include at least a pair of strike plates (two or more rectangular, round, oval, etc. plates). Additionally, the limbs and the risers include physical alignment mechanisms, e.g. counter-sunk opening and conical protrusions. In various embodiments, the physical alignment mechanisms are used to not only secure the limbs to the riser but to align the spring-loaded pins of the riser to the strike plates of the limbs. After the limbs are securely fastened to the riser, it is expected that the limbs are in electronic coupled to at least the power source within the bow.

Various embodiments of the present invention may be used for various archery purposes, such as target shooting, hunting, and for a modified golf game described in the patent application discussed and incorporated by reference, above.

According to one aspect of the invention, an electronic recurve bow is disclosed. One device includes an electronic control riser, wherein the electronic control riser comprises a body configured to be held in a hand of a user. In one embodiment the body includes a power supply configured to provide operating power, a user input coupled to the power supply, wherein the user input is configured to receive a user selection of a draw weight for the electronic recurve bow, a user output coupled to the power supply, wherein the user output is configured to indicate that the draw weight for the electronic recurve bow has at least been electronically specified in response to a confirmation signal, and a controller coupled to the power supply, the user input, and to the user output, wherein the controller is configured to receive the user selection of the draw weight from the user input, wherein the controller is configured to output electronic control signals and the confirmation signal in response to the user selection of the draw weight. A bow may include a pair of electronically controlled laminated limbs coupled to the electronic control riser, wherein each limb comprises a base material and an electronically controllable material, wherein the electronically controllable material comprises a material having a variable stiffness in response to the output electronic control signals.

According to another aspect of the invention, a method for operating an electronic recurve bow having a body and a pair of electronically controlled laminated limbs is disclosed. One technique includes receiving with a user input disposed within the body, a user selection of a draw weight for the electronic recurve bow, and applying with a controller, control signals to the pair of electronically controlled laminated limbs in response to the user selection of the draw weight. A method may include indicating with a user output disposed within the body, an indication that the control signals to the pair of electronically controlled laminated limbs has been applied.

BRIEF DESCRIPTION OF THE DRAWINGS

In order to more fully understand the present invention, reference is made to the accompanying drawings. Understanding that these drawings are not to be considered limitations in the scope of the invention, the presently described embodiments and the presently understood best mode of the invention are described with additional detail through use of the accompanying drawings in which.

DETAILED DESCRIPTION

Figure 1:
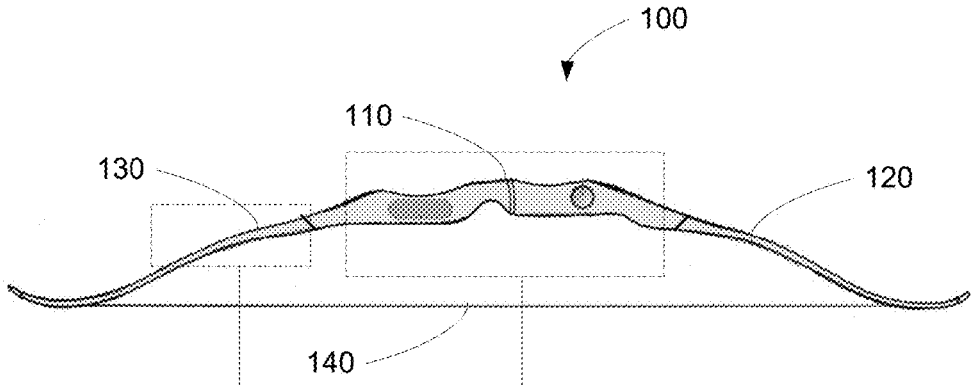
FIG. 1 illustrates an embodiment of an laminated electroactive polymer bow according to various embodiments of the present invention.

FIG. 1 illustrates an embodiment of the present invention. More specifically, FIG. 1 illustrates a recurve bow 100 having a riser portion 110, a pair of electronically tunable limbs 120, and a string 140. In some embodiments, riser portion 110 includes electronic input components that enable a user to specify a performance factor of recurve bow 100, such as a draw weight for recurve bow 100. Additionally, riser portion 110 may include electronic output components as well as data recording components. Embodiments of the present invention are currently being designed by the inventors of the present invention.

In various embodiments, electronically tunable limbs 120 may be removably affixed to riser portion 110 by a user (with tools or without tools). In other embodiments, electronically tunable limbs 120 may be hinged with respect to riser portion 110. In such embodiments, hinges may be located on the front edge of bow 100, and electronically tunable limbs 120 may be folded forward for storage. In other embodiments, hinges may be located on the trailing edge of bow 100, and electronically tunable limbs 120 may be folded backwards for storage. In such embodiments, electronically tunable limbs 120 may be fixed in the extended position (e.g. FIG. 1) via one or more cotter-type pins.

Figure 2:
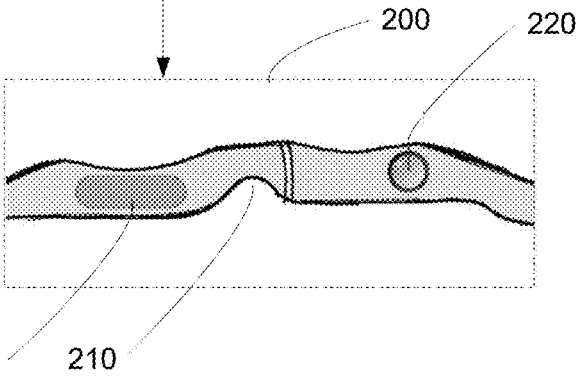
FIG. 2 illustrates a close-up view of one embodiment of the present invention.

Illustrated in FIG. 2 is a close-up portion 200 of riser portion 110. In this example, conventional portions of riser portion 110 are illustrated including a user grip, an arrow rest, arrow plate, and the like. Additionally, in FIG. 2, a portion 230 is indicated that may represent the location of various electronic components, described herein.

In some embodiments, electronic components may include a power supply, e.g. battery, capacitor, fuel cell; a controller; memory; MEMS-based accelerometers or gyroscopes, magnetometers, strain sensors, wireless communications mechanisms, user input components (e.g. dial, buttons); or the like. In addition, a portion 220 is illustrated that may represent the location of various electronic components that provide user feedback, such as a speaker, a programmable display, a series of status lights, a vibration device, or the like. Although portion 230 and 220 are shown on separate portions on riser 110, in other embodiments, these electronic components may be located at a single location, such as portion 230.

Figure 3:
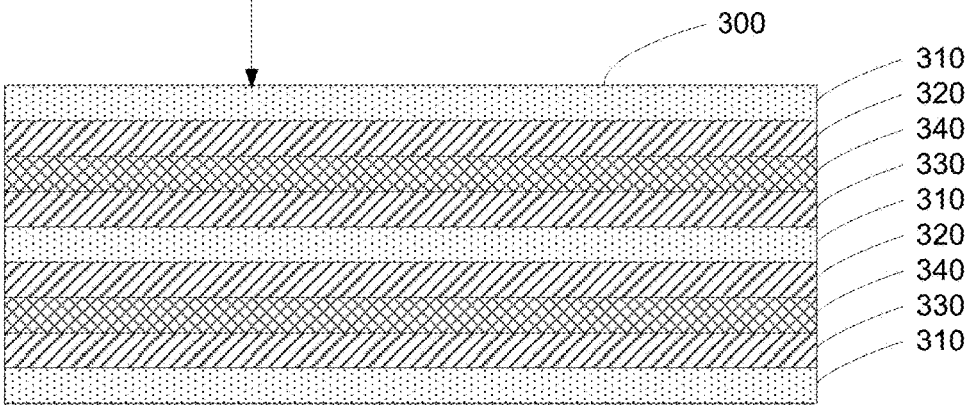
FIG. 3 illustrates another close-up view of one embodiment of the present invention.

FIG. 3 illustrates an embodiment of the present invention. More specifically, FIG. 3 illustrates a close-up portion 130 of an electronically tunable limb 120. As illustrated in FIG. 3, it is contemplated that electronically tunable limbs are formed as a laminate of a number of materials. In one example, a base structural material 310 may be made of wood, fiberglass, carbon fiber, ceramic carbon fiber, foam carbon fiber, metal, or the like.

In various embodiments, an electronically tunable limb 120 may include one or more electroactive polymer layers 330 surrounded by electrodes 310 and 320. In various embodiments, the electroactive polymer layers 330 are associated with a characteristic stiffness that depends upon the electronic control signals provided by electrodes 310 and 320. In various embodiments the electroactive polymer may be formed from a dielectric electroactive polymer; an ionic electroactive polymer; or other material that has a stiffness or physical resistance that is electronically controllable. In FIG. 3, although two such electroactive polymer layers 330 are shown, the inventors believe that in light of the present disclosure, one of ordinary skill in the art will recognize that a fewer number or a greater number of electroactive polymer layers 330 may be used.

Figure 4:
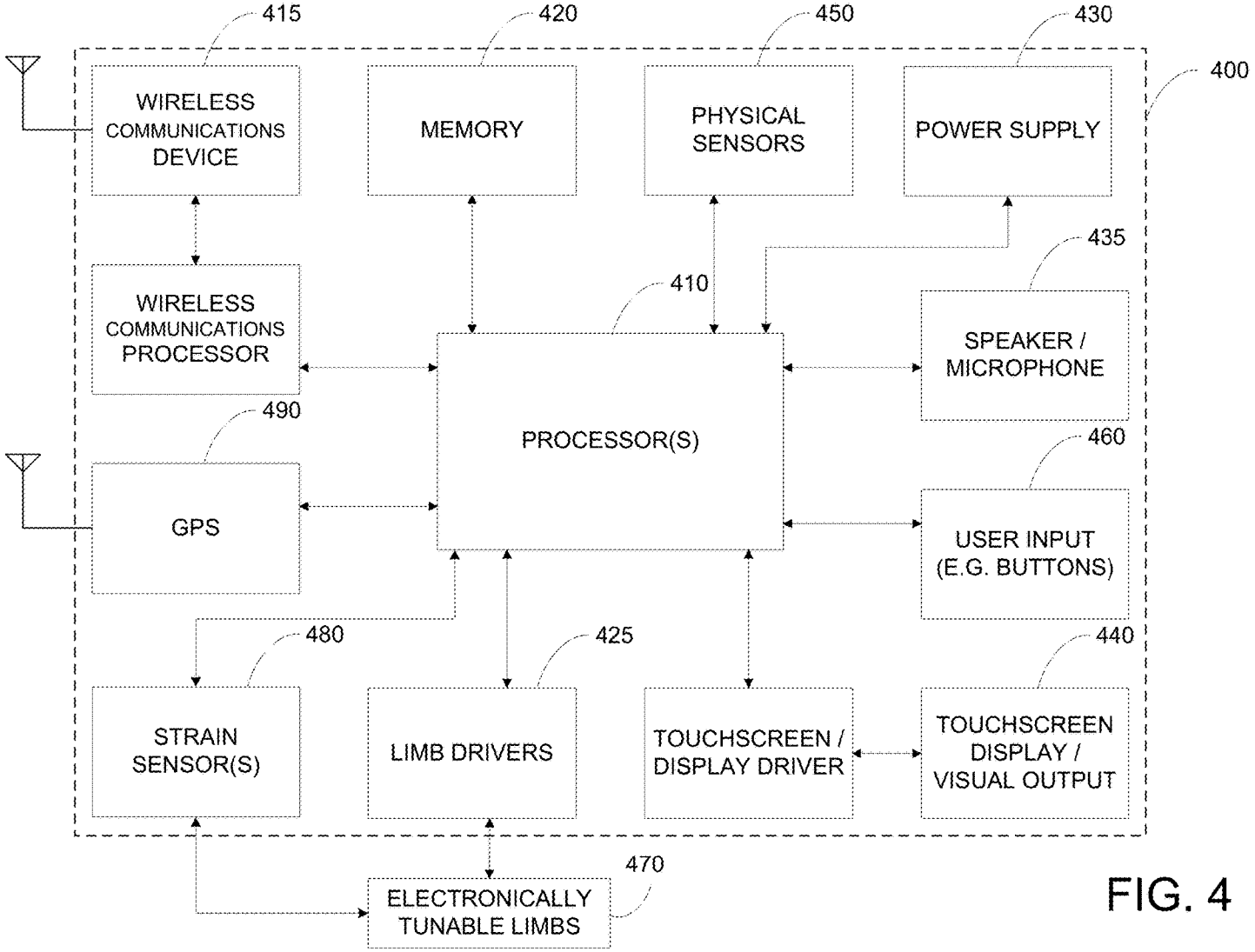
FIG. 4 illustrates a block diagram according to embodiments of the present invention.

FIG. 4 illustrates an embodiment of the present invention. More specifically, FIG. 4 illustrates a block diagram of various embodiments of the present invention.

In FIG. 4, an electronic system 400 for an electronically tunable limb 405 is illustrated. Electronic system 400 includes a controller or processor 410, a memory 420, a power supply 430, a visual output device (and driver) 440, a MEMS devices 450 (e.g. a MEMS accelerometer, a MEMS gyroscope, a magnetometer), a strain sensor 480, a GPS module 490, a wireless communications module (and processors) 415, a user input module 460, a driver circuit 425, an audio input/output device 435. Also illustrated is the electronically tunable limb 470.

In various embodiments controller or processor 410 may be implemented using a conventional processor or microcontroller, such as available from or based upon a design from Intel, Qualcomm, ARM, TI, or the like. In various embodiments, processor 410 operates according to instructions stored within memory 420 based upon data received from the different sensors or user inputs, and instructs the output of appropriate data (e.g. electronic control signals, images for display, sound files to play, or the like).

Memory 420 may be implemented using any conventional type of memory, such as Flash, DRAM, SRAM, EEPROM, or the like. In some embodiments, memory 420 may include portions that are embodied as removable memory (e.g. micro SD card) and non-removable memory (e.g. EERPOM) from the bow. In various embodiments, memory 420 may store program memory for controller 410, bow release data described herein (e.g. time, GPS coordinates, bow inclination, shot strength, or the like). In additional embodiments, as described below, any number of images, audio comments, audio course guide data, or the like may be stored therein.

In various embodiments, power supply 430 may be a rechargeable power device, such as a chemical battery (e.g. Lithium Ion), an ultra-capacitor, a fuel cell, solar cell or the like. Power supply 430 may be removable or fixed within bow. In various embodiments, power supply 430 may be charged via a custom plug, a micro USB plug, a USB-C plug, or the like. In various embodiments, if a USB-type plug is used, the USB-type plug may also be used to input and output data to and from memory 420. Although not specifically shown, it should be understood that other components may be coupled to power supply 430 directly, other than processor 410.

In FIG. 4, visual output device 440 may be embodied as one or more status lights, e.g. LEDs. The visual output of the one or more LEDs may include one LED indicating the status of power supply (e.g. a red LED for low power, green for fully charged; whether the draw weight of the electronically controlled limbs is set (e.g. red color for a not yet ready condition, and a green color indicating the draw weight is set); a shot feedback indicator (e.g. green for a quiet arrow release, orange for a noisy arrow release, and red for a poor arrow release); and the like. In some embodiments, an addressable display may be used to indicate the data described above. The display may be an LCD, OLED, or other type of display, as conventionally used in a smart device (e.g. iPhone, GalaxyS). The visual output device 440 may include a touch screen thus possibly providing user input 460.

In various embodiments, MEMS devices 450 (e.g. MEMS accelerometer, MEMS gyroscope, and magnetometer) may be embodied as any conventional sensors available from commercial vendors such as Bosch, STI Micro, mCube, or the like. In various embodiments, these devices may be three-axis devices that provide feedback to controller 410 as to the physical orientation of the bow relative to a geographic features, (e.g. relative to gravity, magnetic north, or the like.), as well as other features, as described herein (e.g. for detecting a string release). In some embodiments of the present invention, a strain sensor 480 may be provided that can provide data regarding how deflected one or both of the limbs are due to the user pulling on the string. In various embodiments, the deflection data together with the electronically controlled draw weight, described herein, are combined to determine the amount of force actually imparted upon the arrow. For example, if the draw weight is set to 45 lbs, and the arrow is pulled back 32" (as determined by the strain sensor), the calculated amount of force may be 45 lbs; however if the arrow is pulled back only 16" (again, as determined by the strain sensor), the calculated amount of force may be 20 lbs. In various embodiments, calibration of the strain sensor may be performed an in initialization time, in the factory, or the like.

Various embodiments of the present invention may also include GPS module 490 for receiving GPS signals and determining the geographic location of the bow. In various embodiments, GPS module 490 may be used in place of magnetometer 470 to determine the direction the bow is pointed, e.g. 270 degrees.

In FIG. 4, wireless communications module 415 may be provided to receive data from and to transmit data to another electronic device. The other electronic device may be a smart device, a computer, a remote server, or the like. In various embodiments, different communications channels may be used for wireless communications module 415, such as Wi-Fi, Cellular (4G, 3G, Edge, GSM), Bluetooth, short range communications (e.g. ZigBee, Z-wave, etc.), IR, or the like. In various embodiments, the data transferred in and out of the bow may include bow release-related data (e.g. GPS coordinates, time, magnetic direction, inclination, draw-weight, imparted force, and the like.) In other embodiments, a wired interface may also be provided to output such data (e.g. via USB).

In some embodiments, user input module 460 may be provided to allow a user to input settings for the bow, such as draw weight setting, or the like. In some embodiments, user input module 460 may be: a dial-like input; a keypad; physical switches; touch screen input 440; or the like. As described herein, the input settings may include: desired bow draw weight, a distance to a flag, a user score modifier (e.g. based upon distance to a pin, i.e. −1 stroke, −2 strokes, etc.), a number for strokes for a hole, and the like.

In various embodiments, a driver circuit 425 is included to provide the appropriate voltages to electronically tunable limb 470, so as to set a draw weight. The specific range of voltages and/or currents to drive electronically tunable limbs 470 vary according to specific engineering designs for electronically tunable limbs 470, and are expected to vary widely in disclosed embodiments.

In various embodiments, audio input/output device 435 are provided to enable the user to input any of the data described herein and to audibly output any of the data described herein. In some embodiments, voice recognition software may be provided for the user to input data such as, draw weight, number of shots, or the like. In other embodiments, the user voice input may simply be encoded (e.g. .mp3) and stored in memory 420, such as user comments about how the shot felt, and the like. In some embodiments, the audio output may include a commentary about the hole, "425 yards, par 4, dog left;" a distance to a pin, e.g. "150 yards to the pin;" stroke score based upon distance to a pin, e.g. "25 yards to pin, 2 strokes added;" insults or wry comments, e.g. "you call that a shot?"; and the like.

In some embodiments, haptic feedback mechanisms (motors, etc.) may also be included. Such embodiments may provide vibrations to guide a user how far back to draw a bow (e.g. vibrates until the arrow is pulled back the proper amount), provide shot feedback, and the like. Further discussion regarding feedback is provided further below.

In light of the present disclosure, many other combinations, sub-combinations, and combinations with additional functionality of the above hardware are included within embodiments of the present invention. For example, in one embodiment, no speaker/microphone 435 or GPS 490 are provided; in another embodiment, a display 440 merely includes a series of status lights, and no wireless communications devices 415 are provides; and the like. Further, it is asserted that the disclosed embodiments and claims are fully enabled to one of ordinary skill in the art, without undue experimentation.

Figure 5A:
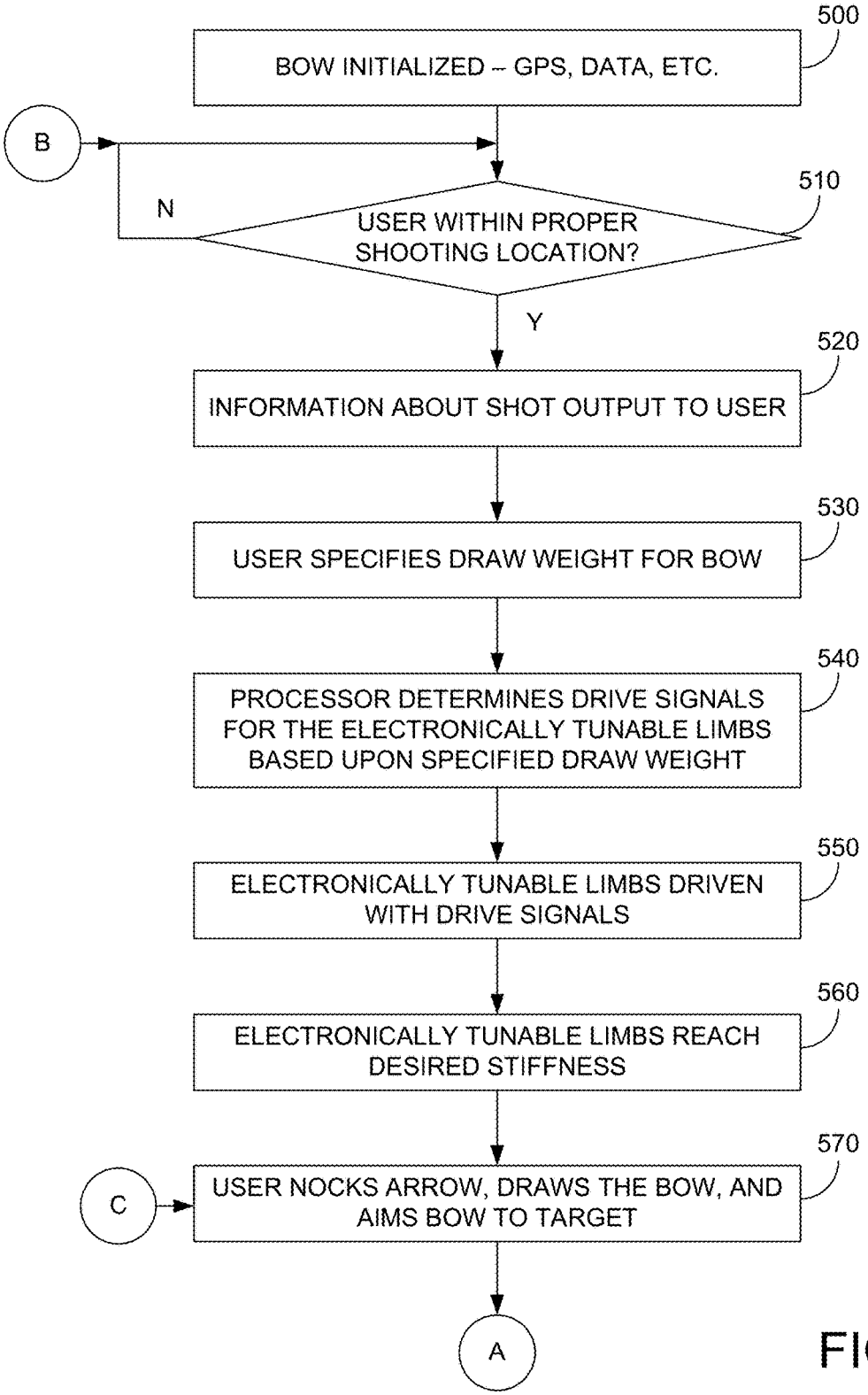
FIGS. 5A-B illustrate a block diagram of a process according to various embodiments of the present invention.
Figure 5B:
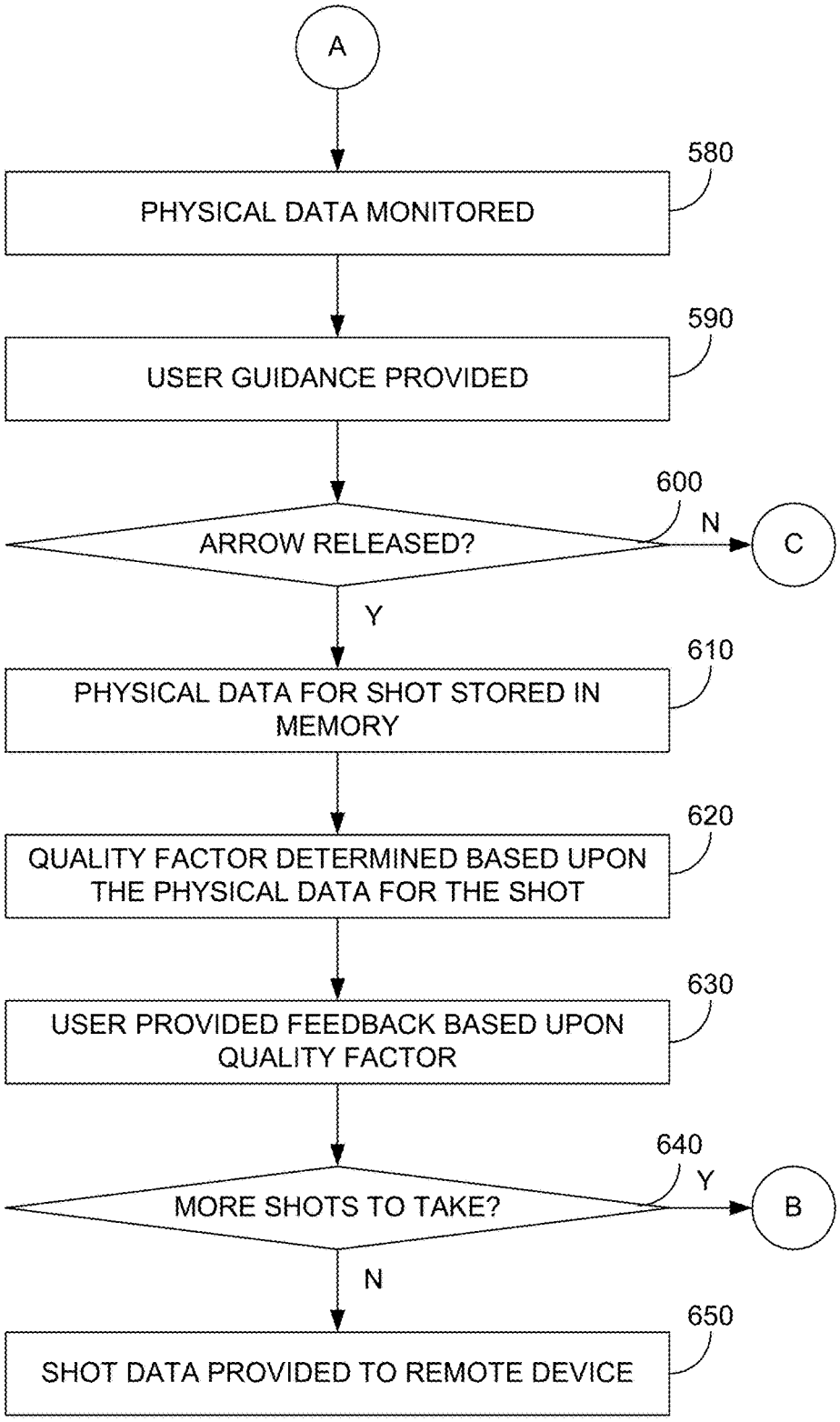

FIGS. 5A-B illustrates a block diagram of a method according to various embodiments of the present invention. Initially, embodiments of a bow may be turned on and initialized, step 500. In various embodiments, this may be done by the user/player, a golf pro shop, a hunting lodge, or the like. It is contemplated that in some embodiments, initialization may include obtaining the current GPS coordinates, as well as loading of the golf course data into memory 420. In some embodiments, memory 420 may be stored in non-volatile memory, accordingly, course data, terrain data, map data, or the like may be pre-loaded at a previous time.

Additionally, the initialization may include specification of a desired draw weight for the bow. In some embodiments, the draw weight for the bow may be set once for the entire round of golf, hunting session, outing, or the like, or may be changed as often as once for each shot. Merely for purposes of illustration, the draw weight is set for each shot, in FIG. 5A.

In various embodiments, for each hole, the user may tell the bow when the user is in a tee box of a hole (or other appropriate shooting location) by pushing a button. Alternatively, based upon GPS coordinates determined by GPS receiver 490, the bow may automatically determine when the user is located within a tee box of a hole (or other appropriate shooting location), step 510.

In some embodiments, when the user is determined to be in the tee box, an audio or display message advising the user about the hole may be played by speaker 435 or display 440, or the like, step 520. For example, a message may be, "Par 3 150 yards." In other embodiments, a message may be provided to the user's smart device, smart watch, or the like.

In some embodiments, the user specifies the draw weight for the shot, step 540 using user input 460 and/or touch screen display 440. In some embodiments, the pull weight may be automatically determined, based upon the shot distance. In such embodiments, the user may provide a maximum pull weight they can safely handle. Further in such embodiments, the draw length may be specified for the user, of a standard draw length may be assumed.

Based upon the user-specified draw weight, processor 410 determines the appropriate driving signals for limb drivers 420, step 540, and limb drivers 420 provides the appropriate driving signals to electronically tunable limbs 470, step 550. In response to the driving signals, the electronically tunable limbs 470 acquire a desired stiffness, step 560, after a short period of time, e.g. less than about 10 seconds, less than about 5 seconds, less than about 1 second, etc. In some embodiments, a sound or light output from the bow may indicate that the period of time has elapsed. In other embodiments, described below, the driving signals to the electronically tunable limbs is performed only after the user releases an arrow.

In various embodiments, the user nocks an arrow, begins to draw the bow, and begins to aim the bow to the desired target, step 570. In various embodiments, while some or all of the above functions are being performed, the physical measurement devices described above, e.g. GPS, accelerometer, magnetometer, gyroscope, strain sensor, or the like, are typically active and providing output data, step 580.

In some embodiments, feedback may be provided to guide to the user about the shot, step 590. For example, in some embodiments, vibrations may be generated, sounds may be played, lights may be lit, and the like. In some embodiments, if haptic feedback is provided, the bow may vibrate as the user draws the bow, and stops vibrating when the arrow is pulled back the correct draw distance. In other examples, for each shot, the bow may determine an approximate desired heading (e.g. where the arrow should be shot), determine an approximate desired angle of inclination (e.g. how high into the sky the bow should be pointed), and the like. In such cases, the processor may compare the current direction the bow is pointed in to the desired heading for the bow. If the user is off a great deal (e.g. desired heading 270 degrees, bow heading 230 degrees), the bow may vibrate, until the user is pointing the bow in approximately 270 degrees (e.g. within a range of about 260 degrees to about 280 degrees). In another example, the processor may vibrate until the user points the bow within a range of about 30 degrees to about 45 degrees into the sky, or the like. The pattern of the vibrations may be different so the user may determine what to adjust, prior to releasing the arrow.

In various embodiments, other user feedback may be provided, such as an audio sound that disappears when the arrow is approximately pointed in the correct direction, the arrow is pulled back the proper draw distance, the arrow is within a correct inclination range, and the like. In such embodiments, the audio messages may be different, (e.g. "more to the left," "higher," "keep on drawing," "perfect heading," "ok, stop pulling," and the like). In still other embodiments, visual indications may provide the feedback. For example, eight red LEDs may surround a green LED in a 3×3 grid. When the bottom left red LED is lit, the user is pointing the bow to the left of the desired direction, and with too little of an inclination; when the middle right red LED is lit, the user is pointing too far to the right; when the green LED is lit, the bow is pointed in approximately the correct direction, with approximately the correct inclination. Additionally, in some embodiments, a row of red LEDs with a final green LED may be provided. These lights may provide visual indication to the user as to the proper draw distance for the arrow. For example, as the user draws the arrow, the red LEDs all light up, and when the arrow is drawn the correct draw distance, the final green LED lights up. In such embodiments, feedback from the strain sensor may be used to help determine when the draw distance is achieved. In still other embodiments, combinations of status lights, audio signals, and haptic feedback may be provided to guide the user.

In some embodiments, the user releases the arrow, step 600. In various embodiments, this condition may be determined by the processor monitoring one or more of the physical measurement devices. As examples, the processor may determine a sharp decrease in data from a strain sensor; the processor may determine a sharp acceleration data from an accelerometer; the processor may determine a sound from a microphone; or the like. In light of the above, many other ways to sense release of the arrow are contemplated and included in embodiments of the present invention.

In response to the arrow release, physical parameters/data of the bow for the shot may be recorded by the processor (e.g. 410) into memory (e.g. 420), step 610. In various embodiments, the data may include GPS coordinates, heading or direction of the bow, inclination of the bow, the draw weight of the bow, the amount of strain imparted in the electronically tunable limbs, and the like. Other pre-shot data (as well as post shot data) may also be recorded, such as a sound clip (e.g. reflecting the user's or the user's party's reaction to the shot), a video clip (e.g. showing the arrow in flight), or the like. Feedback data described in step 590 may also be recorded in memory, in some embodiments.

In some embodiments, a quality factor may be determined for the shot, step 620. In such examples, the quality factor may be based upon one or more of the physical parameters determined pre-shot and/or post-shot. For example, if the accelerometers provide data indicating a large vibration after the arrow is released, this may determine that the arrow was not released cleanly. Accordingly, the quality factor may be lowered for that shot. In another example, if the heading of the bow deviates from an expected direction for a shot, this may determine that the bow was not aimed correctly. Accordingly, the quality factor may also be lowered for that shot. In some embodiments, the feedback data described in step 590 may also be used to determine the quality factor. In various embodiments, the quality factor, if determined may also be recorded into memory.

In some embodiments, based upon a quality factor, the user may be provided feedback with a visual and/or audio indicator, step 630. In some examples, a red, yellow or green light may be output; an audio file may be played; a vibration may be output; or the like. Other exemplary audio commentary may include: "Nice shot!", "Look at that baby go!" "You're the man/woman!" "Another one bites the dust!" "Yeah baby!" "Come to papa!", a baby crying sound, applause sound, thunder sound, whistle sound, and the like. In some embodiments, one or more counters may be associated with each audio commentary, and limits may be applied to how many times each audio commentary may be output (e.g. once or twice). Such embodiments should reduce the possibility of certain audio commentaries being annoying to the users.

In various embodiments, the user wants to take a series of shots during an outing, step 640, the process above may be repeated for the subsequent shots. For example, in embodiments directed to a golf-type game, the above process may be repeated for each hole the user plays.

In some embodiments, after each shot, hole, round, or the like, the data stored on the bow may be transferred to a remote device, step 650, e.g. a user's smart device, a server associated with the golf course, a tournament scoring server, or the like. The communication may utilize one or more of the above described communication mechanisms, e.g. Wi-Fi, cellular, USB, memory card, or the like.

In some embodiments, the electronically tunable limbs are not driven with the driving signals before the arrow is drawn. Only after the arrow is drawn fully, are the electronically tunable limbs programmed to have the appropriate draw weight. Accordingly, such embodiments may be relatively easy for the user to draw the arrow back, and only before firing, is the draw weight programmed into the limbs. As the user feels the increase in draw weight, the user may release the arrow. In such embodiments, the arrow is thus driven with a higher force than the initial draw weight.

In other embodiments, the electronically tunable limbs are not driven with the driving signals until the arrow is drawn and released. In such embodiments, the user draws the arrow back with a relatively-low draw weight (e.g. 25 lbs.) and then aims the bow. As the user releases the string, using one or more of the above physical sensors, the bow determines that the user has released the string. For example, an accelerometer may determine a shock; a physical strain sensor may sense a sudden decrease in strain; or the like. In these embodiments, right after the bow string is released, the electronically tunable limbs are energized and the limbs acquire an increased stress. This increase in limb stress accelerates the string, and thus the arrow with a force (e.g. 75 lbs.) that is greater than the initial draw weight (e.g. 25 lbs.). In various embodiments, is believed that the user will feel an additional force with their bow holding hand as the additional induced stress of the electronically tunable limbs propels the arrow forwards. The inventors believe these embodiments are desirable because users are only required to draw back and hold an arrow with a low draw weight (e.g. 20 lbs.), and when the user releases the arrow, the arrow is accelerated as though the bow had a higher draw weight (e.g. 60 lbs.). Such embodiments provide the benefits and advantages of conventional compound bows, and are mechanically much simpler.

In other embodiments, combinations or sub-combinations of the above disclosed embodiments of the invention can be advantageously made. For example, in other embodiments of the present invention, when used for a golf-type game as described in the above-referenced patent application, a number of shots may automatically be recorded for each hole, and the user may specify modifications to the score for the hole depending upon the distance to the target/pin. In other embodiments, the electronically tunable limbs may be used upon a compound bow. In such embodiments, the electronically tunable stiffness for the limbs may be combined with the compound structure to provide an even larger range of draw weights for an arrow. In some embodiments, a range finder may be provided. In such embodiments, the range finder can provide the user with an estimate of distance to a desired location (e.g. on a golf course, to a target, etc.) Based upon the distance, the desired draw weight for the bow may automatically be determined and set. Further, based upon the draw weight, the desired shot heading, the desired inclination, the desired arrow draw, or the like may be determined. As discussed above, any combination of status lights, audio messages, haptic feedback, or the like may aid the user in aiming the bow to the desired shot heading, inclination, arrow draw, or the like. In light of the present disclosure, the inventors believe that one of ordinary skill in the art will understand other modifications are disclosed, and within the scope of embodiments of the present invention.

The block diagrams of the architecture and flow charts are grouped for ease of understanding. However it should be understood that combinations of blocks, additions of new blocks, re-arrangement of blocks, and the like are contemplated in alternative embodiments of the present invention.

The specification and drawings are, accordingly, to be regarded in an illustrative rather than a restrictive sense. It will, however, be evident that various modifications and changes may be made thereunto without departing from the broader spirit and scope of the invention as set forth in the claims.

What is claimed is:

1. An electronic recurve bow comprising:

an electronic control riser, wherein the electronic control riser comprises a body configured to be held in a hand of a user, wherein the body comprises:

a power supply configured to provide operating power;

a user input coupled to the power supply, wherein the user input is configured to receive a user selection of a draw weight for the electronic recurve bow; and a controller coupled to the power supply and to the user input, wherein the controller is configured to receive the user selection of the draw weight from the user input, wherein the controller is configured to output electronic control signals in response to the user selection of the draw weight; and a pair of electronically controlled laminated limbs coupled to the electronic control riser, wherein each limb comprises a base material and an electronically controllable material, wherein the electronically controllable material comprises a material having a variable stiffness in response to the output electronic control signals.

2. The electronic recurve bow of claim 1 wherein the base material is selected from a group consisting of: wood, fiberglass, carbon fiber, ceramic carbon fiber, and foam carbon fiber.

3. The electronic recurve bow of claim 1 wherein the body further comprises a MEMS-based gyroscope coupled to the power supply and to the controller, wherein the MEMS-based gyroscope is configured to determine angle of inclinations of the body;

wherein the body further comprises a MEMS-based accelerometer coupled to the power supply and to the controller, wherein the MEMS-based accelerometer is configured to determine acceleration data of the body.

4. The electronic recurve bow of claim 3 wherein the controller is configured to determine when an arrow is released from the electronically controlled recurve bow in response to the acceleration data, wherein the controller is configured to determine release angles of inclination of the body in response to the acceleration data.

5. The electronic recurve bow of claim 4 wherein the body further comprises a memory coupled to the power supply and to the controller;

wherein the controller is configured to direct the memory to store an indication that an arrow was released and the release angles of inclination; and wherein the release angles of inclination comprise a tilt angle and a roll angle.

6. The electronic recurve bow of claim 4 wherein the body further comprises a GPS receiver coupled to the power supply and to the controller, wherein the GPS receiver is configured to provide GPS coordinates;

wherein the controller is configured to determine release GPS coordinates in response to the acceleration data.

7. The electronic recurve bow of claim 4 wherein the body further comprises a wireless communications unit coupled to the power supply, to the controller, and to a remote receiver;

wherein the controller is configured to provide the wireless communications unit with the release angles of inclination of the body for each arrow released by the electronically controlled recurve bow for communication to the remote receiver.

8. The electronic recurve bow of claim 4 wherein the body further comprises a magnetometer coupled to the power supply and to the controller, wherein the magnetometer is configured to determine a heading data of the body; and wherein the controller is configured to determine a release heading of the body in response to the acceleration data.

9. The electronic recurve bow of claim 1 wherein the electronically controllable material comprises an electroactive polymer.

10. The electronic recurve bow of claim 9 wherein the electroactive polymer is selected from a group consisting of: dielectric electroactive polymer, and ionic electroactive polymer.

11. An method for operating an electronic recurve bow having a body and a pair of electronically controlled electroactive polymer laminated limbs comprising:

receiving with a user input disposed within the body, a user selection of a draw weight for the electronic recurve bow;

applying with a controller, control signals to the pair of electronically controlled laminated limbs in response to the user selection of the draw weight; thereafter indicating with a user output disposed within the body, an indication that the control signals to the pair of electronically controlled laminated limbs has been applied.

12. The method of claim 11 wherein the electronically controlled laminated limbs comprises a base material and an electronically controllable material, wherein the electronically controllable material comprises a material having a variable stiffness in response to the control signals; and wherein the base material is selected from a group consisting of: wood, fiberglass, carbon fiber, ceramic carbon fiber, and foam carbon fiber.

13. The method of claim 11 further comprising:

determining with a MEMS-based gyroscope disposed within the body of the bow, the angle of inclinations of the body; and determining with a MEMS-based accelerometer disposed within the body of the bow, the acceleration data of the body.

14. The method of claim 13 further comprising:

determining with a additional controller within the body when an arrow is released from the electronically controlled recurve bow in response to the acceleration data; and determining with the additional controller or a third controller within the body release angles of inclination of the body in response to the determination that the arrow is released.

15. The method of claim 14 further comprising storing in a memory within the body, an indication that the arrow was released and the release angles of inclination of the body.

16. The method of claim 15 wherein the release angles of inclination comprise a tilt angle and a roll angle.

17. The method of claim 14 further comprising:

determining with a GPS receiver within the body, GPS coordinates associated with the body; and determining with the controller within the body, release GPS coordinates associated with the body in response to the determination that the arrow is released.

18. The method of claim 14 further comprising:

outputting with a wireless communication unit within the body, the release angles of inclination to a remote device selected from a group consisting of: a smart device, a remote server.

19. The method of claim 14 further comprising determining with a magnetometer within the body, heading data of the body; and determining with the controller within the body, release heading data in response to the determination that the arrow is released.

20. The method of claim 11 wherein the electronically controllable material comprises a first electrode, a second electrode and an electroactive polymer disposed between the first electrode and the second electrode; and wherein the applying with the controller, the control signals to the pair of electronically controlled laminated limbs comprises applying the control signals to the first electrode and the second electrode.

21. The method of claim 11 wherein the electroactive polymer is selected from a group consisting of: dielectric electroactive polymer, and ionic electroactive polymer.

* * * * *